United States Patent [19]

Takizawa et al.

[11] Patent Number: 4,879,570

[45] Date of Patent: Nov. 7, 1989

[54] BROADCASTING WAVE RECEPTION ANTENNA

[75] Inventors: Akio Takizawa; Syozo Saito, both of Saitama, Japan

[73] Assignee: Nippon Antenna Co., Ltd., Tokyo, Japan

[21] Appl. No.: 168,647

[22] Filed: Mar. 16, 1988

[30] Foreign Application Priority Data

Mar. 24, 1987 [JP] Japan ..... 62-69981
Jan. 28, 1988 [JP] Japan ..... 63-18664

[51] Int. Cl.[4] ..... H01Q 7/08
[52] U.S. Cl. ..... 343/713; 343/742; 343/788; 343/802; 343/867; 343/872
[58] Field of Search ..... 343/788, 787, 711, 713, 343/867, 742, 712, 797, 799, 872, 802, 895

[56] References Cited

U.S. PATENT DOCUMENTS

| | | | |
|---|---|---|---|
| 2,481,978 | 9/1949 | Clough | 343/712 |
| 3,623,116 | 11/1971 | Green et al. | 343/788 |
| 3,634,888 | 1/1972 | Reidy | 343/788 |
| 3,683,389 | 8/1972 | Hollis | 343/788 |
| 3,896,448 | 7/1975 | Killen et al. | 343/713 |
| 4,758,166 | 7/1988 | Bonnett et al. | 343/713 |

FOREIGN PATENT DOCUMENTS

| | | | |
|---|---|---|---|
| 1012656 | 7/1957 | Fed. Rep. of Germany | 343/788 |
| 62-75615 | 5/1987 | Japan . | |

*Primary Examiner*—Rolf Hille
*Assistant Examiner*—Michael C. Wimer
*Attorney, Agent, or Firm*—Flynn, Thiel, Boutell & Tanis

[57] ABSTRACT

A broadcasting wave reception antenna have a magnetic core having multiple radial projections extending on a common plane, and respective projections are provided with coils wound on them.

12 Claims, 4 Drawing Sheets

BROADCASTING WAVE RECEPTION ANTENNA

FIELD OF THE INVENTION

This invention relates to an antenna for receiving broadcasting waves, and more particularly to a magnetic antenna which is installed in a desired interior position of a car and not in the exterior thereof and which ensures wider-band, nondirectional highly-sensitive and reliable reception of broadcasting waves including AM, FM and TV bands.

BACKGROUND OF THE INVENTION

Most antennas heretofore used in cars were pole-type antennas configured to project to the exterior of the car during signal reception. Such an outwardly projecting configuration often invites its destruction. Such a prior art antenna is not configured to receive all different broadcasting bands, i.e. AM, FM and TV bands, and a car requires two or more antennas for reception of different bands. Many antennas outwardly projecting from the car body usually spoil the car appearance. In order to improve the appearance, some cars are provided with a glass antenna. However, since such a glass antenna, although expensive, is not configured to receive all different bands, a single car must use pole-type antennas in addition to the glass antenna in most cases.

There is another antenna of this type which is disclosed in Japanese Utility Model Laying-Open Publication No. 62-75615 which uses ferrite bars having pickup coils wound thereon to pick up a high frequency signal induced in a car roof or other body portion of the car at the boundary between the roof and a pillar portion.

However, since signals passing from the roof to the pillar portion, if any, are weak waves, the antenna must be mounted near the roof, etc. Beside this, the antenna cannot receive signals unless a booster is connected. Also when the booster is used, noises increase during reception of weak broadcasting waves, and hence degrades the signal-to-noise ratio. This necessarily results in signal reproduction difficult to hear. Further, since a significantly wide band amplifier is required to amplify AM, FM and TV bands, this also invites a deterioration of the signal-to-noise ratio and an increase of the manufacturing cost.

In order to establish a complete non-directivity by disposing ferrite bar cores in a crossing relationship and by connecting pickup coils, it is necessary to shift the phase of the induced voltage of one of the coils by $\pi/2$ for subsequent signal composition. However, it is a very difficult technology to shift the phase throughout a wide band. Further, since most car bodies are arcuated at the boundary between the roof and the pillar portion, it is difficult to reliably mount and hold such an antenna there.

SUBJECT OF THE INVENTION

It is therefore an object of the invention to provide an antenna in which a magnetic member has a particular configuration to establish a wide-band and nondirectional property improving the reception efficiency and to ensure an acceptable reception wherever of the car body the antenna is located.

SUMMARY OF THE INVENTION

According to the invention, there is provided a broadcasting wave reception antenna comprising:

a magnetic member having multiple radial projections extending on a common plane;

coils wound on respective said projections of said magnetic member; and a cable connecting said coils to a receiver.

When coils on the radial projections on the magnetic member are all connected in series to form a loop type antenna, reception of electromagnetic waves is not largely affected by the position of the antenna in the car body. It is rather preferable to slightly isolate the antenna from the car body to improve the antenna gains. When the magnetic member is formed as a single body having multiple radial projections, no phase shifting is required to establish a nondirectional property of the antenna. Beside this, the series-connection of all coils on respective radial projections establishes a property tunable at AM, FM and TV bands.

When the coils on the radial projections are divided into two groups and connected in series in each group so as to form a dipole antenna, a wide-band and nondirectional property is established as given by the aforegoing loop type antenna.

BRIEF DESCRIPTION OF THE DRAWINGS

FIG. 8(*b*) is a side elevation of the assembly of FIG. 7 after mounted in position of a car in a compressed fashion;

DETAILED DESCRIPTION

Figure 1:
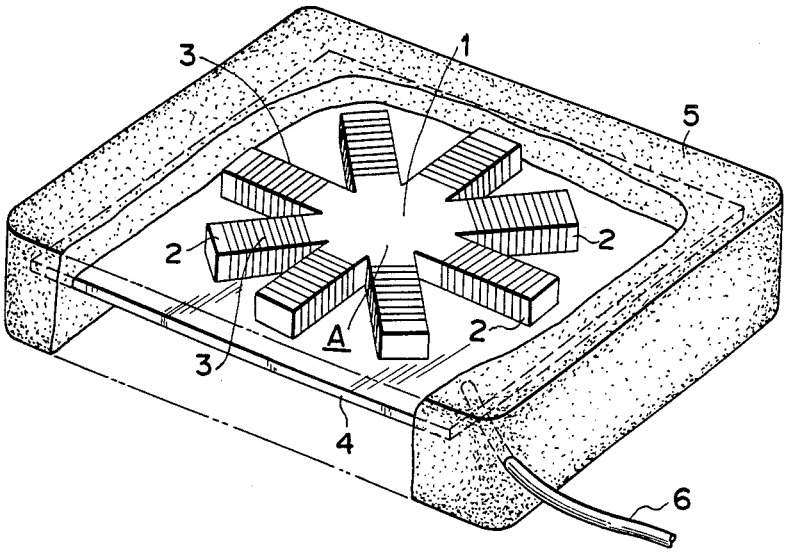
FIG. 1 is a perspective view showing an inventive antenna fully embedded in an insulating material which is partly cut out to show the antenna therein.

The invention is described below in detail, referring to preferred embodiments illustrated in the drawings.

FIG. 1 shows an embodiment in which a magnetic member 1 has radially extending projections 2 wound with coils 3 to form an antenna A at a base 4 thereof. The magnetic member 1 is fully embedded in an insulating material. As shown at (*a*) and (*b*) in FIG. 2, the magnetic member 1 is formed in a single body having radial projections 2 extending on a common plane. Respective projections 2 are provided with coils wound thereon which are connected as described later, and a supply line 6 extending therefrom is connected to a receiver (not shown). The single-body arrangement of the magnetic member 1 having coplanarly extending projections 2 permits any complicated configuration or arrangement of the projections other than those in FIG.

2, without doubling or tripling the thickness thereof, unlike the prior art arrangement in which two or more magnetic members are piled and hence increase the entire thickness. Therefore, the single-body magnetic member 1 may originally have an increased thickness to provide a large cross-sectional area of each projection 2. The coplanarly extending relationships between the projections 2 ensures a close magnetic coupling. As a result, the antenna exhibits a high gain under selected coil winding conditions and selected connecting conditions between the coils, and this permits omission of the booster used in the prior art arrangement.

FIG. 1 shows the magnetic member 1 as having eight projections 2. However, the substantially same capacity is obtained by other configurations including that of FIG. 2(*b*) provided that a plurality of projections 2 are formed. FIG. 3 shows a connection configuration between respective coils to form a loop-type antenna, so that the antenna is tuned at any received frequencies in AM, FM and TV bands to effectively receive electromagnetic waves.

Figure 4A:
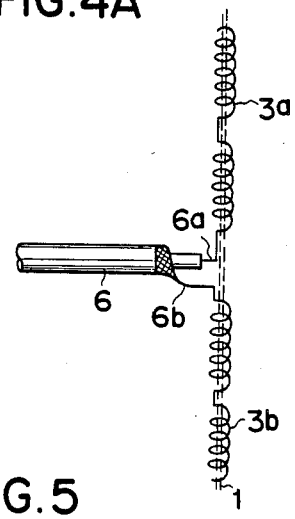
FIGS. 4(*a*) and 4(*b*) are views for explanation of a dipole antenna.
Figure 4B:
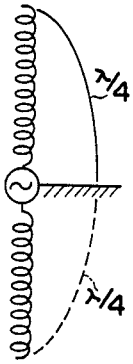

FIG. 4(*a*) shows a connection for forming a dipole antenna in which the coils are divided into two antenna coil groups 3*a* and 3*b* and are connected in each group. One end of one antenna coil group 3*a* is connected to a signal line 6*a* of the supply line 6 whereas one end of the other antenna coil group 3*b* is connected to a ground connection 6*b* of the supply line 6 so as to form the dipole antenna shown in FIG. 4(*b*).

Figure 5:
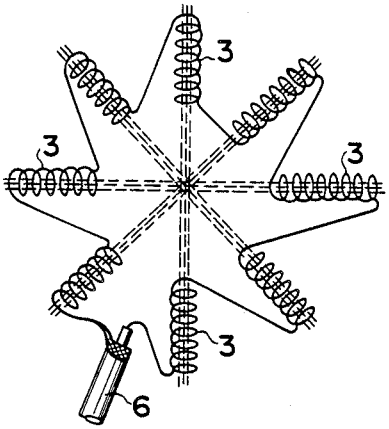
FIG. 5 shows an exemplary connection between loop-shaped coils.

FIG. 5 shows an arrangement of the loop-connected antenna according to the invention in which the coils 3 on respective projections 2 are connected in series sequentially. In this case, the coils 3 may be connected, skipping respective adjacent ones.

Figure 6:
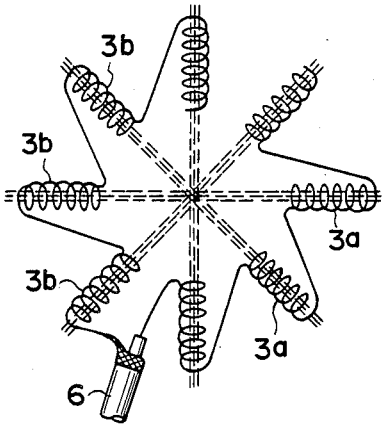
FIG. 6 shows an exemplary connection of coils divided into two groups in a dipole configuration.

FIG. 6 shows a dipole antenna referred to above regarding FIG. 4 in which coils 3*a*—3*a* in one group and coils 3*b*—3*b* in the other group are connected in sequence, respectively. In this case, the number of coils in one group need not be identical to the number of coils in the other group. That is, one group may include one or two coils 3*a*, with the remainder coils 3*b* being connected to form the other group. Therefore, there are a great number of connecting configurations.

As described above, the inventive antenna is made of a magnetic member (core) which is a single body having radially extending projections 2 each having a relatively large cross-sectional area and therefore reduces the loss in the magnetic flux. Therefore, the antenna is particularly suitable for use as a car antenna which requires a nondirectional property so as to ensure all directional reception during navigation of the car.

Figure 2A:
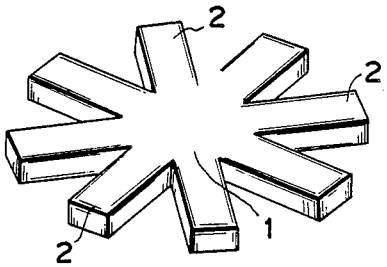
FIGS. 2(*a*) and 2(*b*) show different preferred configurations of a magnetic member.
Figure 2B:
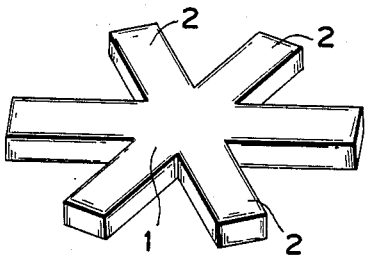
Figure 3:
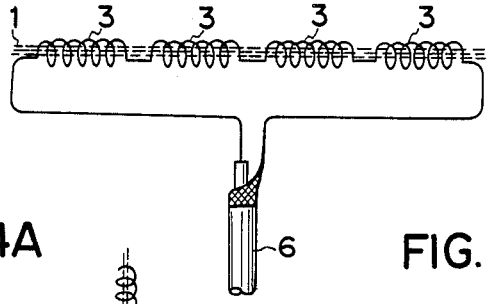
FIG. 3 is a view for explanation of a loop type antenna.

Although the magnetic member 1 may be formed in a single body by sintering ferrite powder or other ferromagnetic powder, it may be made from multiple ferromagnetic bars which are united together to form a flat plane as shown in FIG. 2.

FIGS. 7 through 11 show a further embodiment of the invention which is particularly suitable as an antenna fully embedded in a wall of a car.

Figure 7:
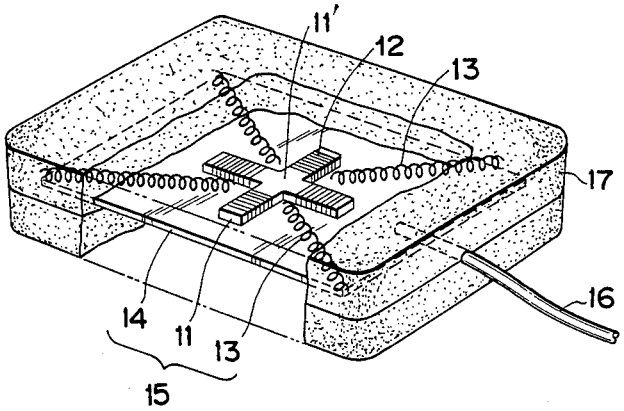
FIG. 7 is a perspective view of an antenna body used in a further embodiment of the invention which is fully embedded in a resilient member shown here as being partly cut out to show the antenna body therein.

FIG. 7 shows an arrangement of an antenna body in which reference numeral 11 designates a low band reception antenna of a tuning type having a known magnetic core wound with coils, and these coils and a capacitor form a tuning circuit. The magnetic core 11' has a cross-like configuration, and coils 12 are wound thereon. The coils 12 are connected to a tuning capacitor element (not shown) to form a tuning circuit for reception of low band waves. Reference numeral 13 denotes a high band reception antenna. The illustrated arrangement includes multiple high band reception antennas 13 in the form of spiral contracted antennas. These antennas 11 and 13 form an antenna body 15 from which a cable 16 secured to a base member 14 is extracted. The antenna body 15 has a flat, planar configuration having a thickness D1 of about 10 mm, and is fully embedded in a soft resilient member 17 which may be sponge, cotton or other insulating material having a large compression ratio. The antenna A of FIG. 1 may be used in lieu of the antenna body 15.

Figure 8A:
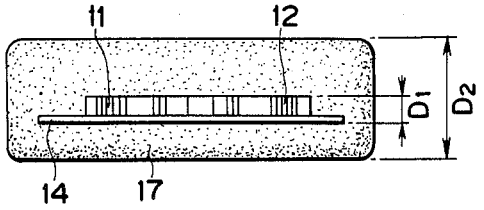
FIG. 8(*a*) is a side elevation of the assembly of FIG. 7 before mounted in position of a car.
Figure 8B:
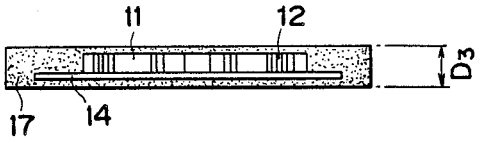
Figure 9:
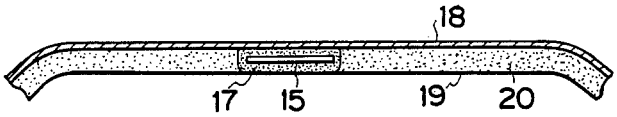
FIGS. 9 and 10 show where and how the assembly of FIG. 1 is mounted in a line manufacturing process.

FIGS. 8(*a*) and 8(*b*) are cross-sectional views showing the antenna body 15 and the resilient member 17 wrapping it closely. FIG. 8(*a*) shows an antenna assembly consisting of the antenna body 15 and the resilient member 17 before it is mounted in position of a car, and the thickness D2 amounts to about 40 to 60 mm. FIG. 8(*b*) shows the antenna assembly after it is mounted between a car body wall 18 and an interior wall member 19 of a car as shown in FIG. 9. The resilient member 17 is compressively sandwiched by the car body wall and the interior wall member so as to exhibit its minimum thickness D3 which approaches $D3 \approx D1$ (where the symbol $\approx$ means "approximately equal"). The antenna assembly may be mounted in any type of car, and the best position therefor can be selected in individual car designs. If the car roof is selected, a thermal insulation sheet 20 is partly cut out to define a space for receiving the antenna body 15 therein during the line manufacturing process of the car. In this process, when the interior wall member 19 is overlaid on the antenna assembly after the latter is put in contact with the car body, the resilient member 17 is compressed by the interior wall member 19 against the car body. Therefore, the antenna assembly is forcibly, immovably held between the car body wall and the interior wall member without requiring any particular fixing means.

Figure 10:
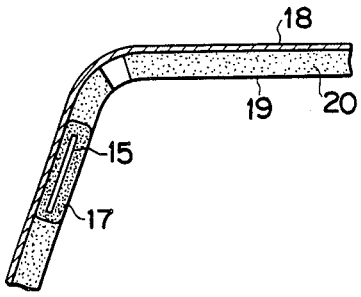
Figure 11:
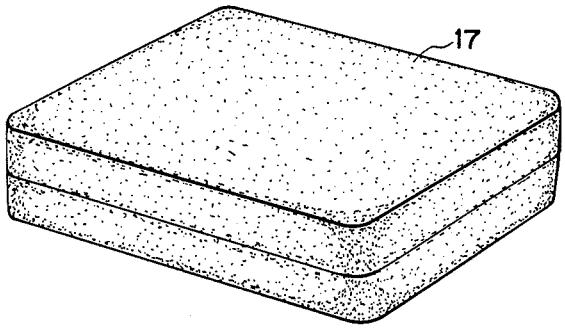
FIG. 11 is a perspective view showing a configuration of a soft resilient member.

FIG. 10 shows the antenna assembly mounted in a rear wall of a car in a line manufacturing process as in the case of FIG. 9. The antenna assembly may also be mounted in a door of a car. FIG. 11 shows a configuration of the soft resilient member 17.

According to the mounting method according to the invention, the antenna fully embedded in the soft resilient member is reliably held between a car body wall and an interior wall member, and immovable with respect to the car body when the car body vibrates during navigation. Therefore, it is not necessary to use any fixture member to fix the antenna assembly in position. Further, the antenna assembly can be mounted in any desired position of a car in a line manufacturing process of the car. The core may also be made by combining multiple bar-shaped cores.

As described above, the inventive antenna includes a magnetic member in which multiple radial projections extend on a common plane, and in which coils wound on the projections are connected in a loop configuration or in a dipole configuration. Therefore, wherever the antenna is mounted in the car, a highly-sensitive, nondirectional reception is ensured for wide band waves including AM, FM and TV bands also during navigation of a car. Further, since the inventive antenna can be mounted in any desired position in a car, it is seldom destroyed and never spoils the appearance of the car, as compared to the prior art antenna which must be extended in the exterior of the car for signal reception.

What is claimed is:

1. A broadcasting wave reception antenna apparatus comprising:

a flat magnetic member having a center portion and a plurality of projections extending radially outwardly from said center portion in respective directions which all lie in a common plane;

a plurality of coils, each said coil being wound around a respective said projection of said magnetic member, a first group of said coils being connected in series with each other between a first pair of first and second nodes, and the rest of said coils being a second group connected in series with each other between a second pair of first and second nodes;

a cable having two conductors which are each connected to said first node of a respective said pair;

a vehicle body wall having spaced first and second wall members; and a soft resilient member having a large compression ratio, having a thickness greater than the distance between said first and second wall members, and having said magnetic member and said coils fully embedded therein, said resilient member being disposed between said first and second wall members under compression and said magnetic member and coils being spaced from each of said wall members.

2. An antenna apparatus according to claim 1, wherein said magnetic member is a single integral part.

3. An antenna according to claim 1, wherein said magnetic member includes a plurality of magnetic bars which are coupled together.

4. An antenna apparatus according to claim 1, wherein each pair of adjacent said coils in each said series-connected group is provided on adjacent said projections of said magnetic member.

5. An antenna apparatus according to claim 4, wherein said coils are wound generally helically on said projections, and wherein one coil of each pair has a radially outer end which is connected to a radially inner end of the other coil of the pair.

6. An antenna apparatus according to claim 5, wherein said second nodes are directly electrically connected so that all of said coils of said first and second groups together form a single loop type antenna.

7. An antenna apparatus according to claim 5, wherein said second nodes are electrically separate so that said first and second groups of coils form respective poles of a dipole antenna.

8. An antenna apparatus according to claim 1, wherein said thickness of said resilient member is substantially greater than the distance between said wall members, said resilient member being substantially compressed by said wall members.

9. An antenna apparatus according to claim 8, wherein said vehicle wall includes a thermal insulation sheet which is disposed between said wall members and which has therethrough an opening corresponding in size and shape to said resilient member, said resilient member being disposed in said opening in said sheet.

10. An antenna apparatus according to claim 1, wherein said first wall member has on a side thereof remote from said resilient member a surface which is an exterior surface of said vehicle body, and said second wall member has on a side thereof remote from said resilient member a surface which is an interior surface of a passenger compartment of said vehicle body.

11. An antenna apparatus according to claim 1, including a platelike base member which extends parallel to and is secured to one side of said flat magnetic member, said base member extending outwardly beyond a radially outer end of each said projection of said magnetic member, and said base member being fully embedded in said resilient member.

12. An antenna apparatus according to claim 1, including a plurality of high band reception antenna coils embedded in said resilient member free of contact with said magnetic member, each said high band reception antenna coil extending from a location near said center portion of said magnetic member approximately radially outwardly between a respective pair of said projections which are adjacent.

* * * * *